US006799957B2

(12) United States Patent
Allen

(10) Patent No.: US 6,799,957 B2
(45) Date of Patent: Oct. 5, 2004

(54) FORMING SYSTEM FOR THE MANUFACTURE OF THERMOPLASTIC NONWOVEN WEBS AND LAMINATES

(75) Inventor: Martin A. Allen, Dawsonville, GA (US)

(73) Assignee: Nordson Corporation, Westlake, OH (US)

( * ) Notice: Subject to any disclaimer, the term of this patent is extended or adjusted under 35 U.S.C. 154(b) by 354 days.

(21) Appl. No.: 10/072,550

(22) Filed: Feb. 7, 2002

(65) Prior Publication Data

US 2003/0147982 A1 Aug. 7, 2003

(51) Int. Cl.[7] ..... B29C 47/34; D01D 5/12

(52) U.S. Cl. ..... 425/66; 425/72.2; 425/74; 425/75

(58) Field of Search ..... 425/66, 72.2, 74, 425/75; 19/299

(56) References Cited

U.S. PATENT DOCUMENTS

| | | | | |
|---|---|---|---|---|
| 2,933,152 A | * | 4/1960 | Carpenter et al. | 55/319 |
| 3,304,163 A | | 2/1967 | Holschlag | 65/11 |
| 3,338,992 A | | 8/1967 | Kinney | 264/24 |
| 3,341,394 A | | 9/1967 | Kinney | 161/72 |
| 3,379,811 A | | 4/1968 | Hartmann et al. | 264/210 |
| 3,423,266 A | | 1/1969 | Davies et al. | 156/167 |
| 3,502,763 A | | 3/1970 | Hartmann | 264/210 |
| 3,509,009 A | | 4/1970 | Hartmann | 161/150 |
| 3,528,129 A | | 9/1970 | Hartmann | 18/8 |
| 3,542,615 A | | 11/1970 | Dobo et al. | 156/181 |
| 3,655,862 A | | 4/1972 | Dorschner et al. | 264/290 |
| 3,692,618 A | | 9/1972 | Dorschner et al. | 161/72 |
| 3,698,610 A | | 10/1972 | Feltgen et al. | 226/7 |
| 3,705,068 A | | 12/1972 | Dobo et al. | 156/441 |
| 3,748,693 A | * | 7/1973 | Jespersen | 425/82.1 |
| 3,802,817 A | | 4/1974 | Matsuki et al. | 425/66 |
| 4,043,739 A | | 8/1977 | Appel | 425/461 |
| 4,064,605 A | | 12/1977 | Akiyama et al. | 28/103 |
| 4,340,563 A | | 7/1982 | Appel et al. | 264/518 |
| 4,405,297 A | | 9/1983 | Appel et al. | 425/72 |
| 4,432,714 A | * | 2/1984 | Forry et al. | 425/83.1 |
| 4,434,204 A | | 2/1984 | Hartman et al. | 428/198 |
| 4,526,733 A | * | 7/1985 | Lau | 264/12 |
| 4,812,112 A | | 3/1989 | Balk | 425/66 |
| 4,813,864 A | | 3/1989 | Balk | 425/66 |
| 4,820,142 A | | 4/1989 | Balk | 425/66 |
| 4,820,459 A | | 4/1989 | Reifenhauser | 264/40.3 |
| 4,851,179 A | | 7/1989 | Reifenhauser | 264/555 |

(List continued on next page.)

FOREIGN PATENT DOCUMENTS

| | | |
|---|---|---|
| EP | 1079012 | 2/2001 |
| EP | 1225563 | 7/2002 |

OTHER PUBLICATIONS

Martin A. Allen, *Air Management System for the Manufacture of Nonwoven Webs and Laminates*, U.S. patent Publication No. 2002/O086072, Published Jul. 4, 2002.

*Primary Examiner*—Robert Davis
*Assistant Examiner*—Joseph S. Del Sole
(74) *Attorney, Agent, or Firm*—Wood, Herron & Evans, L.L.P.

(57) ABSTRACT

A system and methods for collecting and managing air discharged from a melt spinning apparatus. The air management system includes an outer housing defining a first interior space, an intake opening for receiving the discharged air into the first interior space, and an exhaust opening for discharging the air. Positioned within the first interior space is an inner housing defining a second interior space coupled in fluid communication with the exhaust opening and an opening fluidically coupling the first and second interior spaces. The air management system includes a flow control device inside the first interior space that controls the flow of air from the first interior space to the second interior space and an air-directing member outside of the first interior space near the intake opening that extends in a cross-machine direction for dividing the intake opening into two portions in a machine direction.

23 Claims, 11 Drawing Sheets

U.S. PATENT DOCUMENTS

| | | | | |
|---|---|---|---|---|
| 4,997,611 | A | | 3/1991 | Hartmann ..... 264/210.8 |
| 5,028,375 | A | | 7/1991 | Reifenhauser ..... 264/518 |
| 5,032,329 | A | | 7/1991 | Reifenhauser ..... 264/40.5 |
| 5,034,182 | A | | 7/1991 | Sze et al. ..... 264/555 |
| 5,460,500 | A | | 10/1995 | Geus et al. ..... 425/66 |
| 5,545,371 | A | | 8/1996 | Lu ..... 264/555 |
| 5,571,537 | A | | 11/1996 | Geus et al. ..... 425/72.2 |
| 5,609,808 | A | | 3/1997 | Joest et al. ..... 264/210.7 |
| 5,685,757 | A | | 11/1997 | Kirsch et al. ..... 442/344 |
| 5,688,468 | A | | 11/1997 | Lu ..... 264/555 |
| 5,766,646 | A | | 6/1998 | Geus et al. ..... 425/72.2 |
| 5,814,349 | A | | 9/1998 | Geus et al. ..... 425/66 |
| 5,820,888 | A | | 10/1998 | Geus et al. ..... 425/66 |
| 5,935,512 | A | | 8/1999 | Haynes et al. ..... 264/555 |
| 5,984,990 | A | * | 11/1999 | McDonald ..... 55/385.1 |
| 6,182,732 | B1 | | 2/2001 | Allen ..... 156/441 |
| 6,499,982 | B2 | * | 12/2002 | Allen et al. ..... 425/83.1 |

* cited by examiner

FORMING SYSTEM FOR THE MANUFACTURE OF THERMOPLASTIC NONWOVEN WEBS AND LAMINATES

CROSS-REFERENCES TO RELATED APPLICATIONS

This application is related to U.S. application Ser. No. 09/750,820, filed Dec. 28, 2000 and now U.S. Pat. No. 6,499,980, which is expressly incorporated by reference herein in its entirety.

FIELD OF THE INVENTION

The present invention relates to apparatus and methods for manufacturing nonwoven webs and laminates from filaments of one or more thermoplastic polymers.

BACKGROUND OF THE INVENTION

Melt spinning technologies are routinely employed to fabricate nonwoven webs and multilayer laminates or composites, which are manufactured into various consumer and industrial products, such as cover stock materials for single-use or short-life absorbent products, disposable protective apparel, fluid filtration media, and durables including bedding and carpeting. Melt spinning technologies, including spunbonding processes and meltblowing processes, form nonwoven webs and composites from one or more layers of intertwined filaments or fibers, which are composed of one or more thermoplastic polymers. Fibers formed by spunbonding processes are generally coarser and stiffer than meltblown fibers and, as a result, spunbonded webs are generally stronger but less flexible than meltblown webs.

A meltblowing process generally involves extruding a row of fine diameter, semi-solid filaments of one or more thermoplastic polymers from a meltblowing die of a melt spinning apparatus and attenuating the extruded filaments while airborne with high velocity, heated process air immediately upon discharge from the melt spinning apparatus. The process air may be discharged as continuous, converging sheets or curtains on opposite sides of the discharged filaments or as individual streams or jets associated with the filament discharge outlets. The attenuated filaments are then quenched with a flow of a relatively cool process air and blown in a filament/air mixture for depositing in a forming zone to form a meltblown nonwoven web on a collector, such as a substrate, a belt or another suitable carrier, moving in a machine direction.

A spunbonding process generally involves extruding multiple rows of fine diameter, semi-solid filaments of one or more thermoplastic polymers from an extrusion die of a melt spinning apparatus, such as a spinneret or spinpack. A voluminous flow of relatively cool process air is directed at the stream of extruded filaments to quench the molten thermoplastic polymer. A high-velocity flow of relatively cool process air is then used to attenuate or draw the filaments to a specified diameter and to orient them on a molecular scale. The process air is heated significantly by thermal energy transferred from the immersed filaments. The attenuated filaments are propelled in a filament/air mixture toward a forming zone to form a nonwoven web or a layer of a laminate on a moving collector.

Spunbonding processes typically incorporate a filament drawing device that provides the high velocity flow of process air for attenuating the filaments. Hydrodynamic drag due to the high velocity air flow accelerates each filament to a linear velocity or spinning speed significantly greater than the speed of extrusion from the extrusion die and applies a tensile force that attenuates the filaments as they travel from the die to the inlet of the filament drawing device. Some additional attenuation occurs between the outlet of the filament drawing device and the collector as the filaments are entrained by the high velocity air exiting the filament drawing device. Conventional filament drawing devices accelerate the filaments to an average linear velocity less than 8000 meters per minute (m/min).

One deficiency of conventional filament drawing devices is that a large volume of high velocity process air is required for attenuating the filaments. In addition, the process air captures or entrains an excessive volume of secondary air from the ambient environment surrounding the airborne filament/air mixture. The volume of entrained secondary air is proportional to the volume and velocity of the process air exiting the filament drawing device. If left unmanaged, such large volumes of high velocity process and secondary air tend to disturb the filaments as they deposit on the collector, which degrades the physical properties of the spunbonded web.

As mentioned above, large volumes of process air are generated during both the meltblowing and spunbonding processes. Moreover, much of the process air is heated and is moving with high velocities, sometimes approaching sonic velocities. Without properly collecting and disposing of the process air and the entrained secondary air, large volumes of high-speed air would likely disturb personnel working around the manufacturing apparatus and other nearby equipment. Further, large volumes of heated process air would likely heat the surrounding area in which the nonwoven web or laminate is being fabricated. Consequently, attention must be paid to collecting and disposing of this process air and entrained secondary air when manufacturing nonwoven webs and laminates with melt spinning technologies.

Management of the process and secondary air is also important with regard to tailoring the characteristics of the filaments as deposited on the moving collector. The homogeneity of the distribution of deposited filaments across the width of the nonwoven web, or in the cross-machine direction, depends greatly on the uniformity of the air flow in the cross-machine direction around the filaments as they are deposited onto the collector belt. If distribution of air flow velocities in the cross-machine direction is not uniform, the filaments will not be deposited onto the collector uniformly, yielding a nonwoven web that is nonhomogeneous in the cross-machine direction. Thus, the variation of the air flow velocity in the cross-machine should be minimized in order to produce a nonwoven web having homogenous physical properties, such as density, basis weight, wettability, and fluid permeability, in the cross-machine direction. Moreover, large volumes of unmanaged air may also affect fiber formation upstream and downstream of the forming zone in the upstream and downstream fiber-making beams, respectively. Therefore, effective and efficient disposal of large volumes of air is necessary to avert irregularities in the physical properties of the nonwoven web.

Filaments deposited onto the collector have an average fiber orientation in the machine direction (MD) and an average fiber orientation in the orthogonal cross-machine direction (CD). The ratio of filament orientation, termed the MD/CD laydown ratio, indicates the isotropicity of the nonwoven web and strongly influences various properties of the nonwoven web, including the directionality of the tensile strength or flexibility of the web. Given a uniform distribution of air flow velocities in the cross-machine direction, the distribution of air flow velocities in the machine direction controls the MD/CD laydown ratio and, therefore, is an important consideration in the management of the large volumes of process and secondary air.

Various conventional air management systems have been used to collect and dispose of the flow of process and secondary air generated by melt spinning apparatus. Most conventional air management systems include an air moving device, such as a blower or vacuum pump, and a collecting duct having an intake opening positioned below the collector proximate to the forming zone for collecting the air and an exhaust opening coupled in fluid communication with the air moving device for disposing of the collected air. In some of these conventional systems, the negative pressure applied at the intake opening is controlled by one or more movable dampers positioned at the threshold of the intake opening. In other conventional air management systems, the collecting duct is subdivided into an array of smaller air passageways in which each individual air passageway includes an intake opening, an exhaust opening, and an air moving device coupled in fluid communication with the exhaust opening for drawing the collected air into the individual intake openings. Control of the negative air pressure applied at the intake opening is provided by multiple moveable dampers each associated with an exhaust opening of one of the air passageways.

Controlling the distribution of air flow velocities proximate to the forming zone in both the cross-machine and machine directions simultaneously, however, has proven challenging for conventional air management systems. Conventional air management systems, such as those described above, are incapable of systematically controlling the directionality or symmetry of the air flow velocities in the machine direction while maintaining a relatively uniform distribution of air flow velocities in the cross-machine direction. In particular, movable dampers in such conventional systems either are incapable of varying the distribution of air flow velocities in the machine direction or cannot vary the distribution of air flow velocities in the machine direction without significantly reducing the uniformity of the air flow velocities in the cross-machine direction. As a result, conventional air management systems lack the ability to select the distribution of air flow velocities in the machine direction in order to effectively control the MD/CD laydown ratio. It follows those melt spinning processes using such conventional air management systems cannot control or otherwise tailor the properties of the nonwoven web in the machine direction.

What is needed, therefore, is an air management system for a melt spinning system that can manipulate the disposal of the process air so as to control the distribution of air flow velocities near the forming zone for the nonwoven web in the machine direction and maintain a uniform air flow in the cross-machine direction. Also needed is a melt spinning system capable of generating reduced volumes of process air and entrained secondary air for disposal.

SUMMARY OF INVENTION

The present invention provides a melt spinning system and, more particularly, a melt spinning and air management system that overcomes the drawbacks and disadvantages of prior melt spinning and air management systems. The air management system of the invention includes at least one air handler for collecting air discharged from a melt spinning apparatus. The air handler generally includes an outer housing having first walls defining a first interior space and an inner housing positioned within the first interior space and having second walls defining a second interior space. One of the first walls of the outer housing has an intake opening positioned below a collector for admitting the discharged air from a melt spinning assembly into the first interior space and another of the first walls of the outer housing has an exhaust opening for exhausting the discharged air. The second interior space is coupled in fluid communication with the exhaust opening and one of the second walls of the inner housing has an elongate slot with a major dimension in a cross-machine direction and coupling the first interior space in fluid communication with the second interior space.

In certain embodiments of the invention, an adjustable flow control device is positioned in the first interior space of the air management system. The flow control device is operative for controlling the flow of discharged air between the first interior space and the second interior space.

In other embodiments of the invention, an air-directing member is positioned outside of the first interior space of the air management system and proximate to the intake opening. The air-directing member extends in the cross-machine direction and divides the intake opening into first and second portions in the machine direction.

According to the principles of the invention, an apparatus is provided which includes a melt spinning apparatus and an air management system having three air handlers. The melt spinning apparatus is operative to extrude filaments of material and is positioned vertically above a collector. A first air handler of the air management system is positioned directly below the melt spinning apparatus in a forming zone. A second air handler is positioned upstream of the first air handler and the forming zone. A third air handler is positioned downstream of the first air handler and the forming zone. The second and third air handlers each include an air-directing member, as described above, and an adjustable flow control device, also as described above.

According to the principles of the present invention, an apparatus is provided that is configured to discharge filaments of material onto a moving collector. The apparatus includes a melt spinning apparatus operative for extruding filaments, a filament drawing device positioned between the melt spinning apparatus and the collector, and an air handler having an intake opening positioned proximate to the collector. The filament drawing device has an inlet for receiving the filaments from the melt spinning apparatus and an outlet for discharging the filaments toward the collector. The filament drawing device is operative for providing a flow of process air sufficient to attenuate the filaments of material. The flow of process air entrains secondary air from the ambient environment between the outlet and the collector. The intake opening of the air handler collects process air discharged from the filament drawing device and secondary air entrained by the process air. The apparatus further includes a forming chamber having a side wall at least partially surrounding the intake opening of the air handler and the outlet of the filament drawing device, an entrance opening upstream of the intake opening, and an exit opening downstream of the intake opening. The side wall defines a process space for the passage of the filaments of material from the outlet of the filament drawing device to the collector and partitions the process space from the surrounding ambient environment. The entrance and exit openings are dimensioned so that at least the collector can traverse the process space. The side wall of the forming chamber includes a perforated metering sheet configured to regulate the flow of air from the ambient environment into the process space.

The invention further provides a method for depositing a nonwoven web of filaments on a collector moving in a machine direction in which filaments of material are discharged from a melt spinning assembly discharging filaments of material from a melt spinning assembly and mixed with a flow of process air. The filaments of material are deposited on the collector and the process air is collected with an intake opening of an air management system having a substantially uniform collection of the discharge air in the cross-machine direction and a selectively variable ratio of air flow velocity in the machine direction to air flow velocity in the cross-machine direction.

Various additional advantages and features of the invention will become more readily apparent to those of ordinary skill in the art upon review of the following detailed description taken in conjunction with the accompanying drawings.

DETAILED DESCRIPTION OF DRAWINGS

DETAILED DESCRIPTION OF PREFERRED EMBODIMENTS

Figure 1:
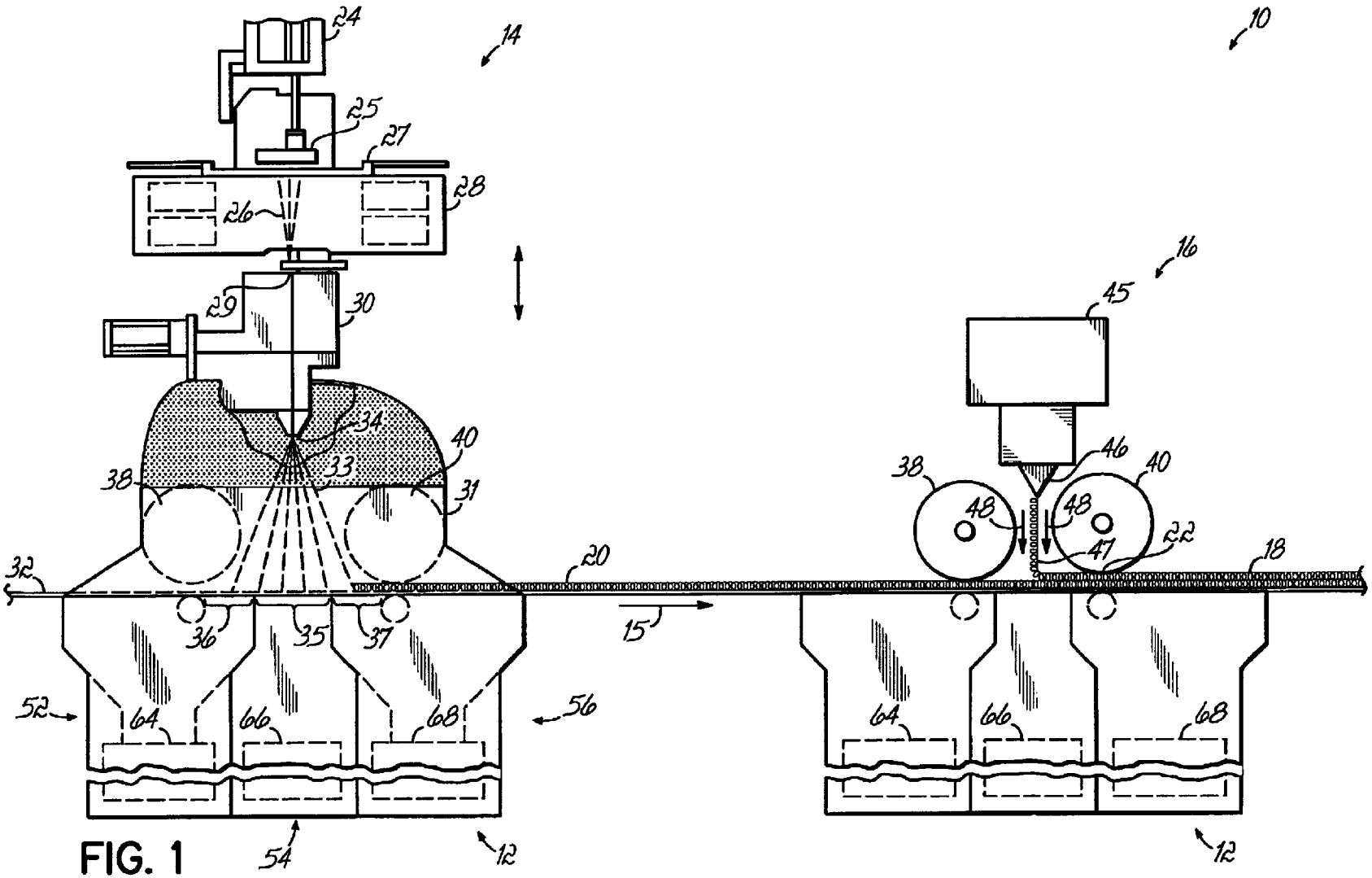
FIG. 1 is a schematic plan view of a two-station production line incorporating the air management system of the invention.

With reference to FIG. 1, a two-station melt spinning production line 10 is schematically illustrated. The production line 10 incorporates an air management system 12 at a spunbonding station 14 and a separate air management system 12 at a meltblowing station 16 downstream of station 14 in a machine direction, indicated on FIG. 1 by arrow 15.

While the air management system 12 has been illustrated in conjunction with the two-station production line 10, the air management system 12 is generally applicable to other production lines having a single station or a plurality of stations. In a single station production line, the nonwoven web can be manufactured using any one of a number of processes, such as a meltblowing process or a spunbonding process. In a multiple-station production line, a plurality of nonwoven webs can be manufactured to form a multilayer laminate or composite. Any combination of meltblowing and spunbonding processes may be used to manufacture the laminate. For instance, the laminate may include only nonwoven meltblown webs or only nonwoven spunbonded webs. However, the laminate may include any combination of meltblown webs and spunbonded webs, such as a spunbond/meltblown/spunbond (SMS) laminate.

With continued reference to FIG. 1, the two-station production line 10 is shown fabricating a two-layer laminate 18 with a spunbonded web or layer 20 formed by spunbonding station 14 on a collector 32, such as an endless moving perforated belt or conveyor, moving generally horizontally in the machine direction 15 and a meltblown web or layer 22 formed on top of web 20 by meltblowing station 16. Additional meltblown or spunbonded webs may be added by additional stations downstream of meltblowing station 16. The laminate 18 is consolidated downstream of the meltblowing station 16 by a conventional technique, such as calendering. It is understood that spunbonded web 20 may be deposited on an existing web (not shown), such as a spunbonded web, a bonded or unbonded carded web, a meltblown web, or a laminate composed of a combination of these types of webs, provided on collector 32 upstream of the spunbonding station 14 and moving downstream on collector 32 to stations 14, 16.

The spunbonding station 14 includes a melt spinning assembly 24 with an extrusion die 25. To form the spunbonded web 20, the extrusion die 25 extrudes a downwardly-extending curtain of thermoplastic fibers or filaments 26 from multiple orifices (not shown) that generally span the width of the collector 32 in a cross-machine direction 17 substantially orthogonal to machine direction 15 and that delimit the width of the spunbonded web 20. The airborne curtain of filaments 26 extruded from the extrusion die 25 passes through a monomer exhaust system 27 that evacuates any residual monomer gas from the extrusion process. The airborne curtain of filaments 26 next traverses a dual zone quenching system 28 that directs two individual flows of cool process air onto the curtain of filaments 26 for quenching the filaments 26 and initiating the solidification process. The process air from the quenching system 28 is typically supplied at a flow rate of about 500 SCFM/m to about 20,000 SCFM/m and has a temperature ranging from about 2° C. to about 20° C.

The airborne curtain of filaments 26 exits the quenching system 28 and is directed by suction, along with a large volume of secondary air from the surrounding environment, into an inlet 29 of a filament drawing device 30. The filament drawing device 30 envelops the filaments 26 with a high velocity flow of process air directed generally parallel to the length of the filaments 26 for applying a biasing or tensile force in a direction substantially parallel to the length of the filaments 26. The filaments 26 are extensible and the high velocity flow of process air in the filament drawing device 30 attenuates and molecularly orients the filaments 26. The attenuated filaments 26 are entrained in the high velocity process air and secondary air when ejected from an outlet 34 of the filament drawing device 30. The mixture of attenuated filaments 26 and high velocity air will be referred to hereinafter as a filament/air mixture 33. The filament/air mixture 33 enters a forming chamber 31, which is provided above the collector 32, and the attenuated filaments 26 in the filament/air mixture 33 are propelled toward the collector 32. The filament drawing device 30 may be mounted on a vertically movable fixture (not shown) for adjustment, as indicated generally by the arrow on FIG. 1, of the vertical spacing between the outlet 34 and the collector 32 among various vertical spacings.

The attenuated filaments 26 of the filament/air mixture 33 are deposited on the collector 32 in a random manner, generally assisted by the air management system 12, which collects the high velocity process and secondary air generated by the spunbonding station 14. The filament/air mixture 33 entrains additional secondary air from the environment surrounding the forming chamber, which is regulated as described below, in its airborne path between the outlet 34 and the collector 32.

Figure 8:
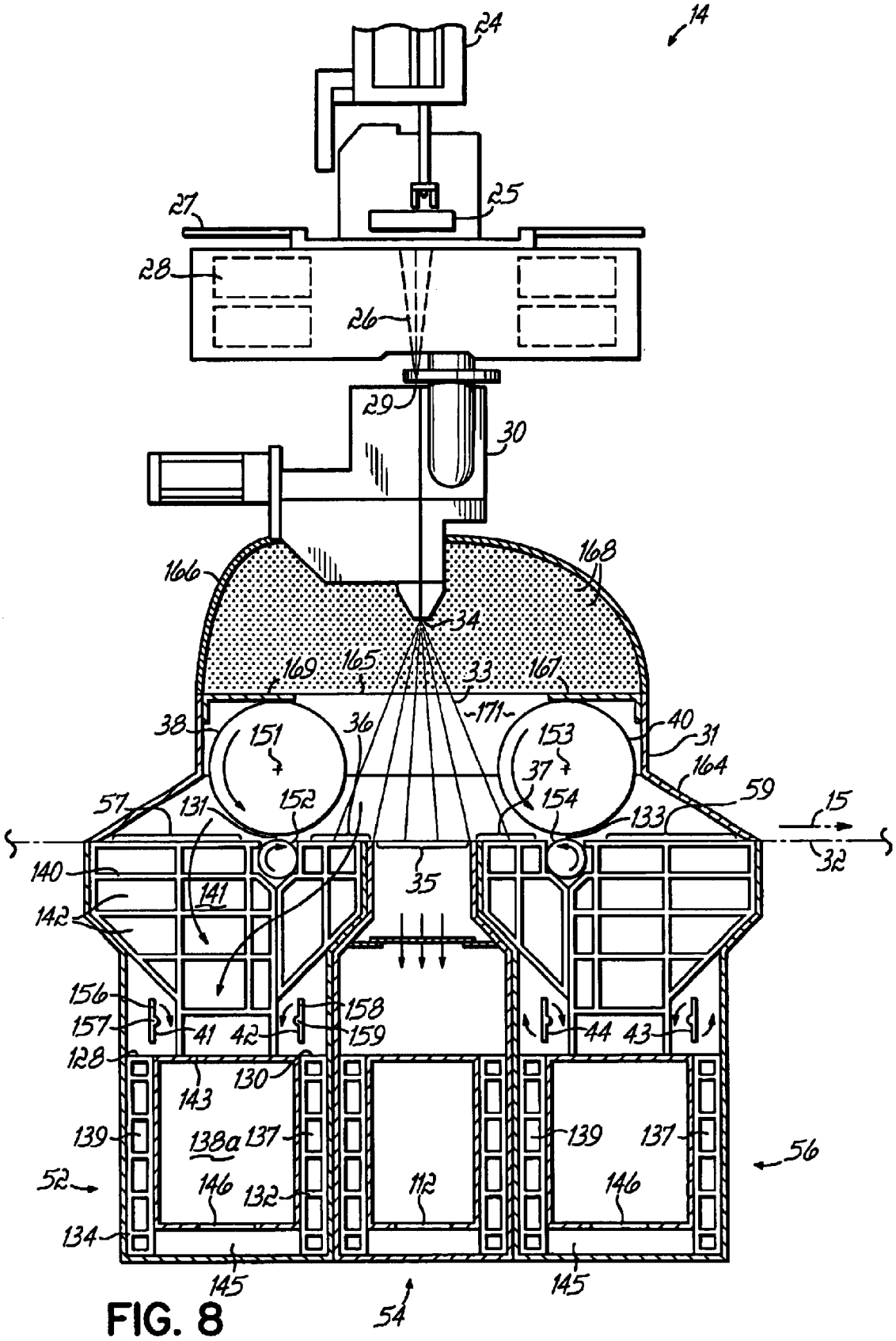
FIG. 8 is a view of the spunbonding station of FIG. 1.

According to the present invention, the air management system 12 includes a pair of spill air control rollers 38, 40, which have a spaced relationship in a direction parallel to the machine direction 15. Defined in the machine direction 15 between spill air control rollers 38, 40 is a forming zone 35 flanked on the upstream side by a pre-forming zone 36 and on the downstream side by a post-forming zone 37. The zones 35, 36, 37 extend lengthwise across the width of the air management system 12 in the cross-machine direction 17. Most of the filaments 26 in the filament/air mixture 33 are deposited on the collector 32 in the forming zone 35. The entraining process air of the filament/air mixture 33 passes through the spunbonded web 20 as it forms and thickens, the collector 32, and any pre-existing substrate on collector 32 for collection by the forming zone 35, pre-forming zone 36 and post-forming zone 37. The collector 32 is perforated so that the process air from the filament/air mixture 33 flows through the collector 32 and into the air management system 12. The process air at spunbonding station 14 is then evacuated by controlled vacuum or negative pressure supplied by the air management system 12. The vacuum in pre-forming zone 36 is selectively controlled by a pair of spill air control valves 41, 42 (FIG. 8) and, similarly, the vacuum pressure in the post-forming zone 37 is selectively controlled by a pair of spill air control valves 43, 44 (FIG. 8).

The meltblowing station 16 includes a melt spinning assembly 45 with a meltblowing die 46. To form the meltblown web 22, the meltblowing die 46 extrudes a plurality of thermoplastic filaments or filaments 47 onto the collector 32, which cover the spunbonded web 20 formed by the upstream spunbonding station 14. Converging sheets or jets of hot process air, indicated by arrows 48, from the meltblowing die 46 impinge upon the filaments 47 as they are extruded to stretch or draw the filaments 47. The filaments 47 are then deposited in a random manner onto the spunbonded web 20 on the collector 32 to form the meltblown web 22. The process air at meltblowing station 16 passes through the meltblown web 22 as it forms, the spunbonded web 20 and the collector 32 for evacuation by the air management system 12.

Several cubic feet of process air per minute per inch of die length flow through each station 14, 16 during the manufacture of the spunbonded web 20 and the meltblown web 22. The process air entrains secondary air from the surrounding environment along the airborne filament path from the extrusion die 25 to the collector 32. The flow of process air and secondary air has a velocity represented by a vector quantity that may be resolved in three-dimensions as the resultant of a scalar component directed vertically toward the collector 32, a scalar component in the machine direction 15, and a scalar component in the cross-machine direction 17.

The air management system 12 efficiently collects and disposes of the process air and any entrained secondary air from the stations 14, 16. More importantly, the air management system 12 collects the process and secondary air such that the process air has a substantially uniform flow velocity in at least the cross-machine direction 17 as the process air passes through the collector 32. Ideally, the filaments 26, 47 are deposited on the collector 32 in a random fashion to form the spunbonded and meltblown webs 20, 22, which have homogeneous properties in at least the cross-machine direction 17. If the air flow velocity through the collector 32 is nonuniform in the cross-machine direction 17, the resultant webs 20, 22 will likely have non-homogeneous properties in the cross-machine direction 17. Therefore, it is apparent that the variation in the magnitude of the component of air flow velocity in the cross-machine direction 17 must be minimized to produce a web 20, 22 having homogeneous properties in cross-machine direction 17.

Figure 2:
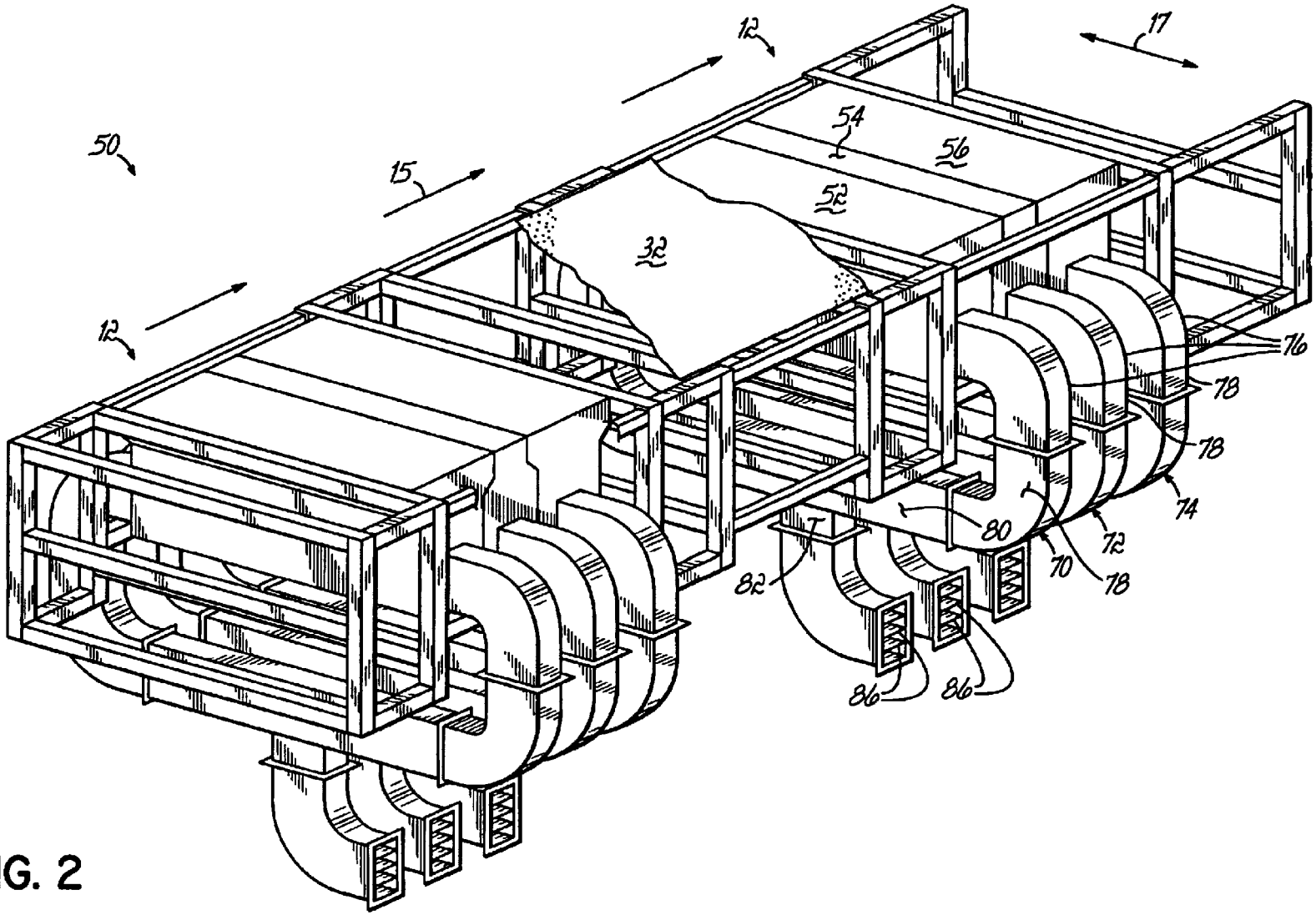
FIG. 2 is a perspective view of the two-station production line of FIG. 1 with the collector belt removed for clarity.

With reference to FIG. 2, transport structure 50 of the two-station production line 10 of FIG. 1 is shown. While the two-station production line 10 includes two air management systems 12, the following description will focus on the air management system 12 associated with the spunbonding station 14. Nonetheless, the description is understood to be equally applicable to the air management system 12 associated with the meltblowing station 16. An air management system similar to air management system 12, and upon which the principles of the present invention represent an improvement, is described in co-pending, commonly-owned U.S. patent application Ser. No. 09/750,820, entitled "Air Management System for the Manufacture of Nonwoven Webs and Laminates" and filed Dec. 28, 2000, which is expressly incorporated by reference herein in its entirety.

Figure 3:
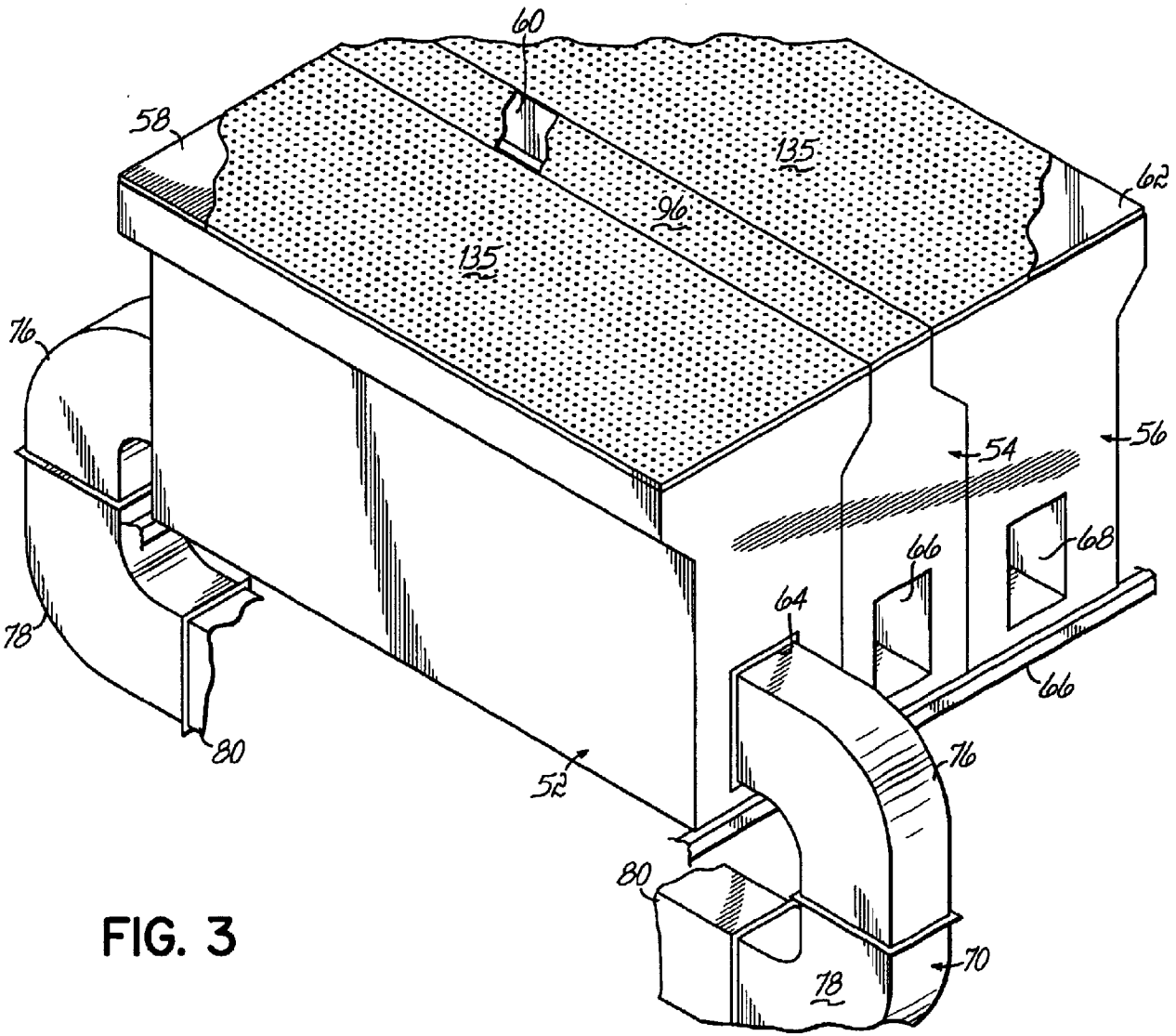
FIG. 3 is a perspective view of the air management system of FIG. 1.

With further reference to FIGS. 2 and 3, air management system 12 includes three discrete air handlers 52, 54, 56 disposed directly below the collector 32. Air handlers 52, 54, 56 include intake openings 58, 60, 62 and oppositely disposed exhaust openings 64, 66, 68. Individual exhaust conduits 70, 72, 74 are connected respectively to exhaust openings 64, 66, 68. Exhaust conduit 70, which is representative of exhaust conduits 72, 74, is comprised of a series of individual components including first elbows 76, second elbows 78, and elongated portion 80. In operation, any suitable air moving device (not shown), such as a variable speed blower or fan, is connected by suitable ducts to elongated portion 80 to provide suction, vacuum or negative pressure for drawing the process air through the air management system 12.

With continued reference to FIGS. 2 and 3, air handler 54 is located directly below the forming zone 35. As such, air handler 54 collects and disposes of the largest portion of the process air used during the extrusion and filament-forming processes to form spunbonded web 20 and the secondary air entrained therewith. The pre-forming zone 36 of the upstream air handler 52 and the post-forming zone 37 of the downstream air handler 56 collect spillover air which air handler 54 does not collect.

Figure 4:
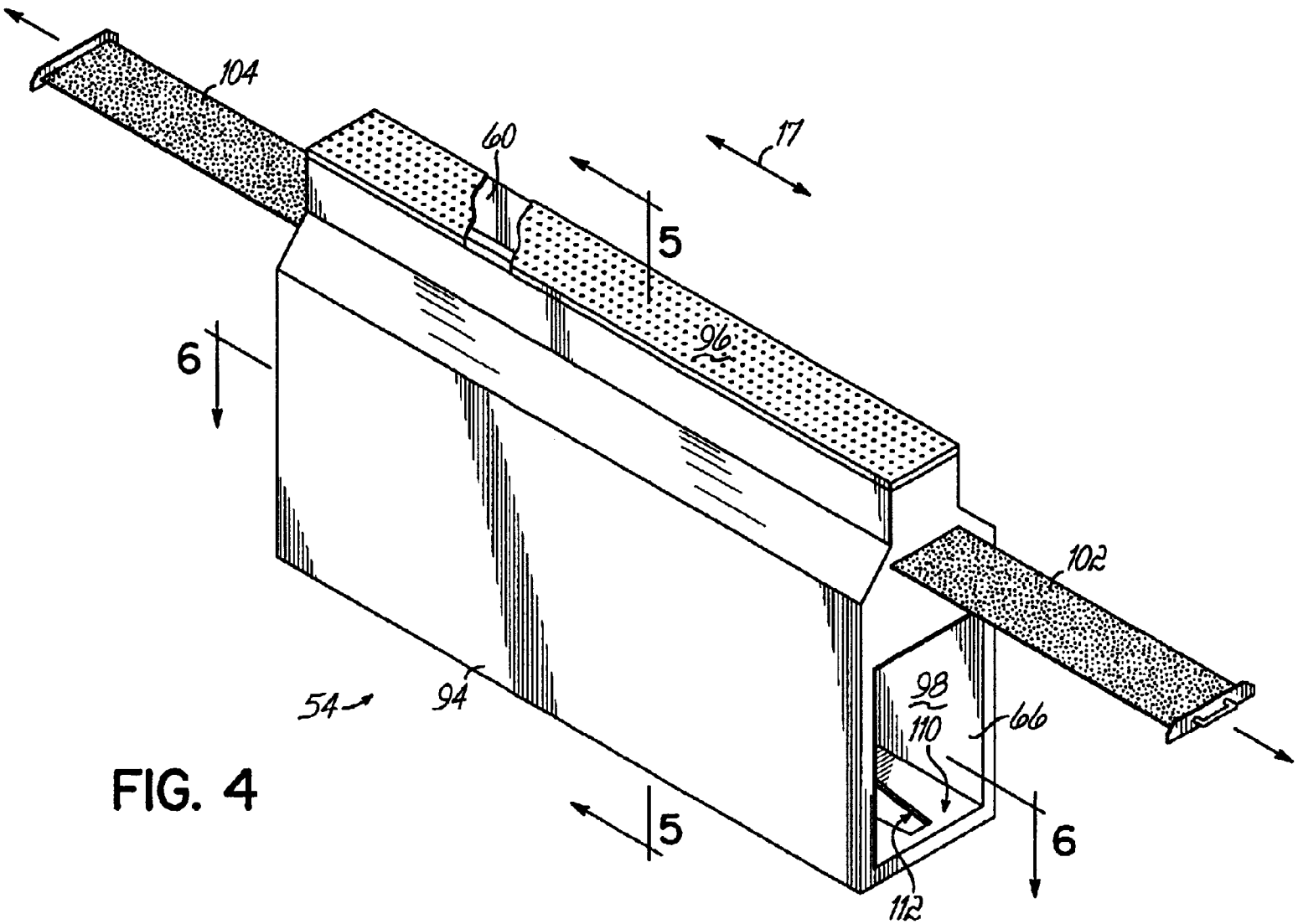
FIG. 4 is a partially disassembled perspective view of the forming zone air handler of FIG. 3.
Figure 5:
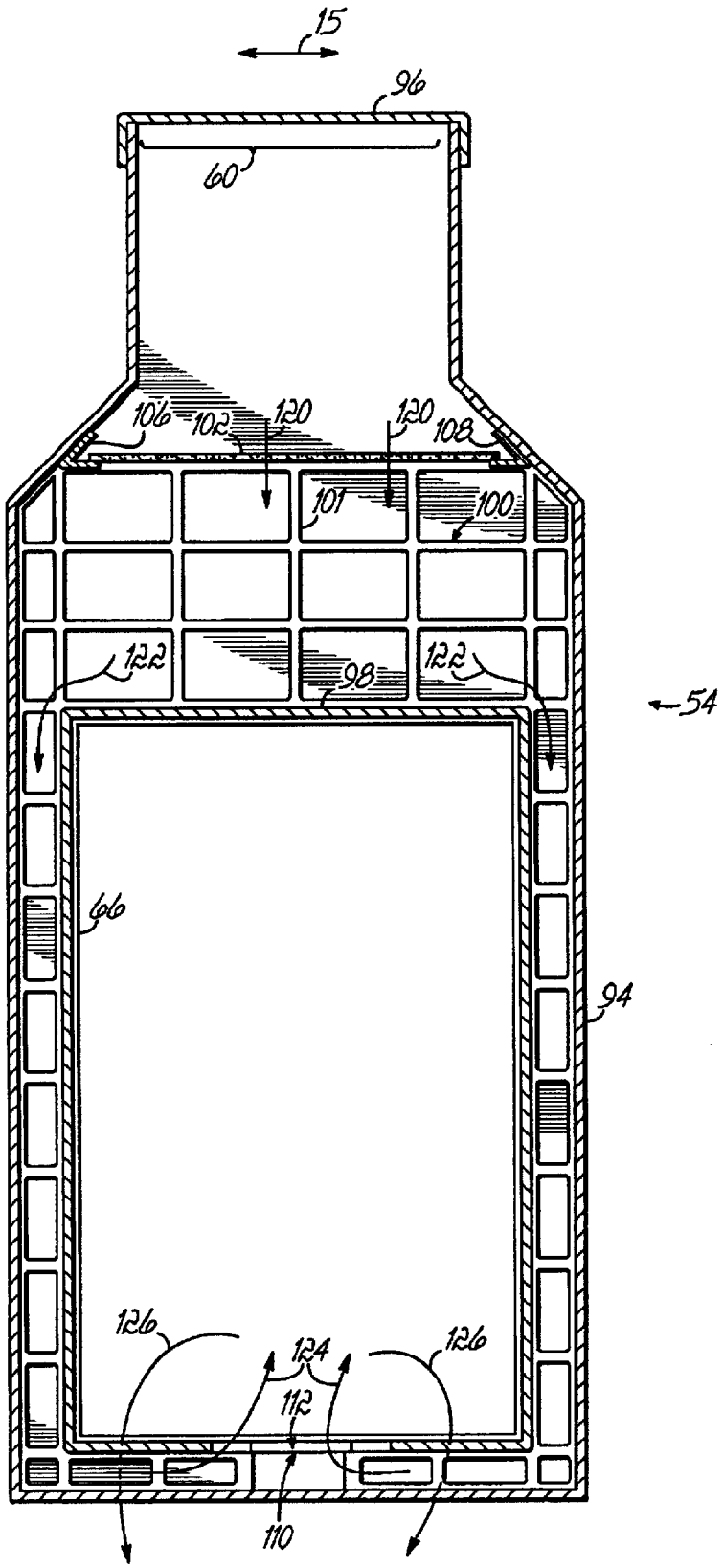
FIG. 5 is a cross sectional view of the forming zone air handler in FIG. 4 taken generally along lines 5-5.
Figure 6:
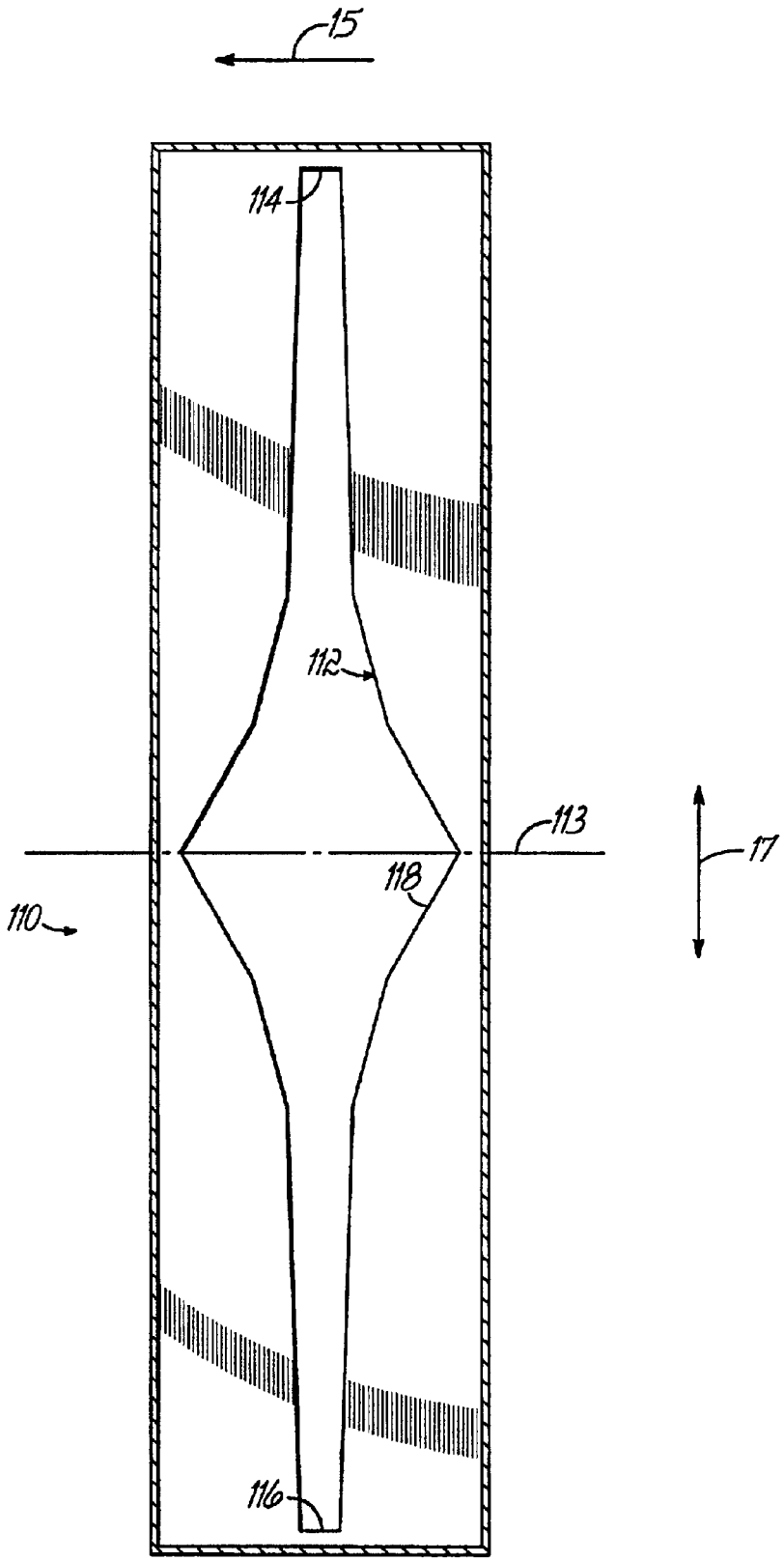
FIG. 6 is a plan view of the forming zone air handler bottom in FIG. 4 taken generally along lines 6-6.

With reference now to FIGS. 4–6, forming zone air handler 54 has an outer housing 94, which includes intake opening 60 and oppositely disposed exhaust openings 66. Intake opening 60 includes a perforated cover 96 with a series or grid of apertures through which the combined process and secondary air flows. Depending on the manufacturing parameters, air handler 54 may be operated without using the perforated cover 96 at all. Air handler 54 further includes an inner housing or box 98 which is suspended from the outer housing 94 by means of spacing members 100 which include a plurality of openings 101 therein. Two filter members 102, 104 are selectively removable from air handler 54 so that they may be periodically cleaned. The filter members 102, 104 slide along stationary rail members 106, 108. Each of these filter members 102, 104 are perforated with a series of apertures through which the combined process and secondary air flows.

The inner box 98 has a bottom panel 110 that includes an opening, such as elongate slot 112, with ends 114, 116 and a center portion 118. As illustrated in FIG. 6, slot 112 has a length or major dimension extending across the inner box 98 in the cross-machine direction 17. An inner periphery of the slot 112 has a minor dimension or width that is relatively narrow at ends 114, 116 and relatively wide at center portion 118. The shape of slot 112 is symmetrical about a centerline 113 extending in the machine direction 15. Specifically, the width of slot 112 in the machine direction 15 generally increases in a direction extending from either of ends 114, 116 toward the centerline 113. The largest width of slot 112 occurs at the centerline 113. The slot 112 could be formed collectively of one or more openings of various geometrical shapes, such as round, elongate, rectangular, etc., operative to reduce variations of air flow velocities in the cross-machine direction 17 at the intake opening 60.

The shape of elongate slot 112 influences the air flow velocity in the cross-machine direction 17 at the intake opening 60. If the shape of the slot 112 is not properly contoured, the air flow velocities at the intake opening 60 may vary greatly in the cross-machine direction 17. The particular shape shown in FIG. 6 was determined through an iterative process using a computational fluid dynamics (CFD) model which incorporated the geometry of the air handler 54. A series of slot shapes were evaluated at intake air flow velocities ranging between 500 to 2500 feet per minute. After the CFD model analyzed a particular slot shape, the distribution of air flow velocities in the cross-machine direction 17 was checked. Ultimately, the goal was to choose a shape for the slot 112 that provided a substantially uniform air flow velocity in the cross-machine direction 17 at intake opening 60. Initially, a rectangular shape for slot 112 was evaluated, yielding a distribution of air flow velocities in the cross-machine direction 17 at the intake opening 60 that varied by as much as twenty percent. With the rectangular shape of slot 112, the air flow velocities near the ends of the intake opening 60 were greater than the air flow velocities approaching the center of the intake opening 60. To address this uneven air flow velocity distribution, the width in the machine direction 15 of each of ends 114, 116 is reduced relative to the width in the machine direction 15 of the center portion 118. After approximately five iterations, the geometrical shape of slot 112 illustrated in FIG. 6 was selected as optimal. That slot shape yields a distribution of air flow velocities at the intake opening 60 that varies by about ±5.0% in the cross-machine direction 17. Such a variation in the cross-machine air flow velocities produces an acceptably uniform air flow in the cross-machine direction 17 for providing adequate homogeneity in the distribution of deposited filaments across the width of the spunbonded web 20.

With specific reference to FIG. 5, process and secondary air enters through perforated cover 96 and passes through porous filter members 102, 104, as illustrated generally by arrows 120. The process air passes through the gap between the inner box 98 and the outer housing 94 as illustrated by arrows 122. The air then enters the interior of inner box 98 through slot 112 as illustrated by arrows 124. Finally, the air exits the inner box 98 through exhaust opening 66 as illustrated by arrows 126 and then travels through exhaust conduit 72. The openings 101 in spacing members 100 allow the air to move in the cross-machine direction 17 to minimize transverse pressure gradients that would otherwise be communicated to the intake opening 60.

As illustrated in FIG. 3, the intake openings 58, 62 of air handlers 52, 56 are significantly wider in the machine direction 15 than intake opening 60 of air handler 54. However, intake openings 58, 62 are divided in the machine direction 15 by the presence of spill air control rollers 38, 40. As best shown in FIG. 8, the negative pressure area of the intake opening 58 is divided into two discrete zones, an upstream zone 57 upstream in the machine direction 15 from spill air control roller 38 and the pre-forming zone 36. Similarly, the negative pressure area of intake opening 62 is divided into two discrete zones, a downstream zone 59 downstream in the machine direction 15 from the spill air control roller 40 and the post-forming zone 37.

Figure 7:
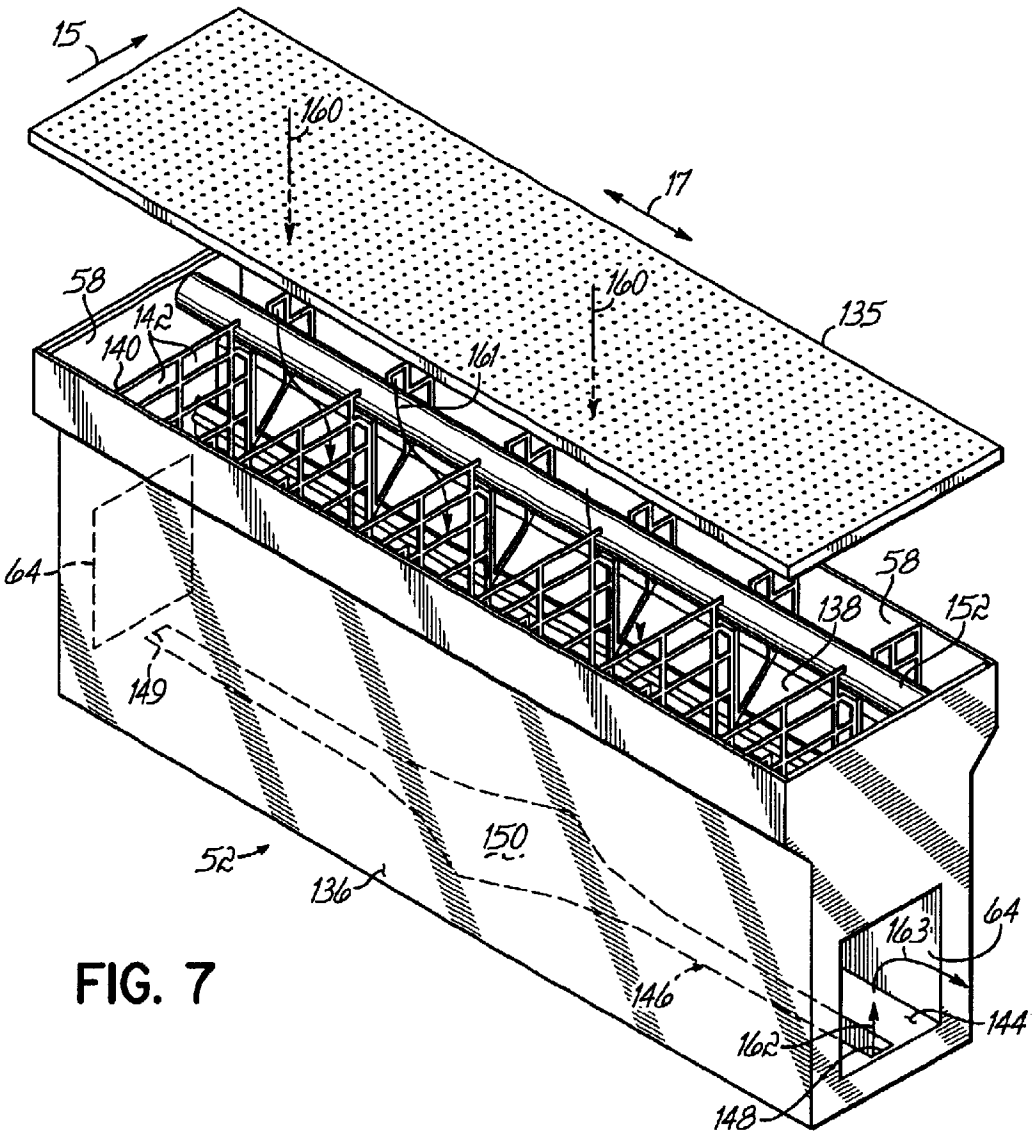
FIG. 7 is a partially disassembled perspective view of one of the spillover air handlers of FIG. 3.

Because of the substantial similarity of air handlers 52 and 56, the following description of air handler 52 applies equally to air handler 56. With reference to FIGS. 7 and 8, air handler 52 has an outer housing 136 which includes intake opening 58 and exhaust openings 64. Intake opening 58 includes a perforated cover 135 with a series of fine apertures through which the process air and entrained secondary air flows. Depending on the manufacturing parameters, perforated cover 135 may be eliminated from air handler 52.

Air handler 52 further includes an inner housing or box 138 that is suspended from the outer housing 136 by multiple latticed dividers 140 having a spaced-apart relationship in the cross-machine direction 17. A flow chamber 141 (FIG. 8) is created in the substantially open volume between the intake opening 58 (FIG. 7) and an upper wall 143 of the inner box 138. Spaced-apart vertical air plenums 137, 139 (FIG. 8) are created by respective spaced-apart gaps in the machine direction 15 between the inner box 138 and the outer housing 136. Air plenum 137 has an air inlet port 128 coupled in fluid communication with flow chamber 141, and air plenum 139 has an air inlet port 130 coupled in fluid communication with flow chamber 141. Each of the latticed dividers 140 includes a plurality of openings 142 that couple the various portions of the flow chamber 141 partitioned by dividers 140. The latticed dividers 140 participate in equalizing the flow of process and secondary air from the intake opening 58 to plenums 137, 139 and operate to disrupt turbulent flow. Air plenum 137 includes latticed dividers 132 and air plenum 139 includes latticed dividers 134 in which dividers 132, 134 have a similar function as latticed dividers 140.

With continued reference to FIGS. 7 and 8, the inner box 138 includes a bottom panel 144 spaced vertically from the outer housing 136 to define a horizontal air plenum 145 (FIG. 8) having opposite open ends respectively coupled in fluid communication with air plenums 137, 139. The bottom panel 144 includes an aperture or slot 146 that is configured similarly to slot 112 and that couples the air plenum 145 in fluid communication with the interior of inner box 138. Slot 146 is operative to direct air arriving via plenums 137, 139, 145 into the interior of inner box 138. An inner periphery of slot 146 includes ends 148, 149 and center portion 150. Like slot 112, the width at center portion 150 of slot 146 is greater than the width at ends 148, 149. Air is exhausted from the interior of the inner box 138 via exhaust openings 64 (FIGS. 1 and 3). It is appreciated that air handler 52 is representative of air handler 56 so that like features are labeled with like reference numerals in FIG. 8.

With reference to FIG. 8, spill air control roller 38 extends in the cross-machine direction 17 across the length of the intake opening 58 and is mounted for free rotation on a shaft 151, which is supported at opposite ends by the forming chamber 31. The spill air control roller 38 is journalled on bearings (not shown) to the shaft 151 and is suspended above the collector 32 with which roller 38 has a rolling engagement. The spill air control roller 38 has a length in the cross-machine direction 17 across the length of the intake opening 58 substantially equal to the width of the collector 32 and to the width of the spunbonded web 20.

A smooth-surface anvil or support roller 152 is located below the collector 32 and extends in the cross-machine direction 17 across the length of the intake opening 58. The support roller 152 is positioned vertically relative to the spill air control roller 38 by a distance sufficient to provide an entrance opening 131 for collector 32 and any substrate residing thereupon. The rollers 38, 152 frictionally engage collector 32 and rotate in opposite directions as collector 32 is conveyed into the forming chamber 31 of spunbonding station 14. This spatial relationship between the collector 32, the spill air control roller 38, and the support roller 152 significantly reduces the aspiration of secondary air from the surrounding environment of forming chamber 31 that might otherwise disturb fiber laydown on the collector 32 inside the forming chamber 31 while allowing entry of the collector 32 and any substrate residing thereupon into the process space 171.

The spill air control roller 38 is formed of an unperforated sheet of metal and is shaped geometrically as a right circular cylinder having a smooth, cylindrical peripheral surface. Each opposite transverse end of the spill air control roller 38 may be closed with a circular disk of sheet metal (not shown) each having a central aperture through which shaft 151 protrudes for mounting to the forming chamber 31.

Similarly, spill air control roller 40 is mounted for free rotation to the forming chamber 31 by a shaft 153 and an anvil or support roller 154 that operates in conjunction with spill air control roller 40 to define post-forming zone 37 by dividing intake opening 62 of air handler 56. Collector 32 and spunbonded substrate 20 formed by spunbonding station 14 exit the forming chamber 31 by passing through an exit opening 133 provided between roller 40 and roller 154. Spill air control roller 40 has similar attributes as spill air control roller 38 and hence the above description of control roller 38 applies equally to control roller 40. It is apparent that the spill air control rollers 38, 40 and support rollers 152, 154 provide guide surfaces spaced in the machine direction 15 which guide the filament/air mixture 33 (FIG. 1) to target zones 35, 36, 37.

With reference to FIG. 8 and continuing to describe spillover air handler 52 with the understanding that the description is equally applicable to air handler 56, spill air control valve 41 is positioned in flow chamber 141 proximate to air inlet port 128 of vertical air plenum 139 and spill air control valve 42 is positioned in flow chamber 141 proximate to air inlet port 130 of vertical air plenum 137. Spill air control valves 41 and 42 are selected from any of numerous mechanical devices by which the flow of air may be regulated by a movable part that partially obstructs one or more ports or passageways.

Spill air control valves 41 and 42 are illustrated in FIG. 8 as having a butterfly valve structure, although the present invention is not so limited. Spill air control valve 41 comprises a shutter 156, which may be rectangular, extending in the cross-machine direction 17 and a rotatable shaft 157 to which shutter 156 is diametrically attached. Spill air control valve 41 regulates the flow of process air into air inlet port 128 of vertical air plenum 139. Specifically, the shaft 157 is rotatable about an axis of rotation extending in the cross-machine direction 17 along its length so that shutter 156 can regulate the flow of process air into vertical air plenum 139. The rotational orientation of shutter 156 at least partially determines the flow resistance of process air being evacuated through intake opening 58 upstream of spill air control roller 38 and into vertical air plenum 139.

Similarly, spill air control valve 42 includes a shutter 158 extending in the cross-machine direction 17 and a rotatable shaft 159 to which shutter 158 is diametrically attached. Spill air control valve 42 regulates the flow of process air into air inlet port 130 of vertical air plenum 137. Specifically, the shaft 159 is rotatable about an axis of rotation extending along its length so that shutter 158 can regulate the flow of process air into vertical air plenum 137. The rotational orientation of shutter 158 at least partially determines the flow resistance (i.e., air volume and velocity) of process air being evacuated through intake opening 58 downstream of control roller 38 in pre-forming zone 36 and into vertical air plenum 137. Regulation of the flow resistance with spill air control valves 41, 42 regulates the negative air pressure or vacuum applied in pre-forming zone 36. The spill air control valves 41, 42 further regulate the negative air pressure or vacuum applied upstream of the spill air control roller 38 in upstream zone 57 for holding any material on the collector 32 in intimate contact therewith.

With continued reference to FIG. 8, spill air control valves 43, 44 of air handler 56 have a similar construction to spill air control valves 41, 42 and function similarly for selectively regulating the negative air pressure in the post-forming zone 37 and upstream of spill air control roller 40 in downstream zone 59. The application of negative air pressure upstream of spill air control roller 40 in post-forming zone 37 is particularly important for controlling the accumulation of freshly-deposited filaments 26 on the outer peripheral surface of the roller 40.

Spill air control valves 41–44 may be manually adjusted or mechanically coupled with actuators (not shown) for varying the flow of process air into plenums 137, 139. Sensing devices (not shown), such as vacuum gauges or flow meters, may be provided in air handler 52 for monitoring the relative vacuum pressures or air flows in vertical air plenums 137, 139. A control system (not shown) may be provided for receiving feedback from the sensing devices and controlling the actuators for varying the orientations of spill air control valves 41–44.

The collection efficiency for the filaments 26 on collector 32 is a function of several characteristics of the filament/air mixture 33, including the temperatures of the air and filaments 26, the air velocity, and the air volume. The spill air control valves 41–44 may be adjusted to match the vacuum pressures in at least zones 35, 36, 37 for optimizing the collection efficiency. The vacuum pressures will differ in each of zones 35, 36 and 37 due to differing pressure drops across the thickness of the overlying material, including the collector 32, any substrate thereupon and the spunbonded web 20. Although the vacuum pressures must be sufficient for evacuating the process air, the vacuum pressures must not be so great as to compress the spunbonded web 20 as it is formed on collector 32. The spill air control valves 41–44 are configured and/or dimensioned such that the distributions of air flow velocities in the cross-machine direction 17 are not significantly effected by their presence adjacent the vertical air plenums 137, 139.

As mentioned above, the flow path of process and entrained secondary air through air handler 52 is similar to the flow path of process and entrained secondary air in air handler 56. With reference to FIGS. 7 and 8 and as described with regard to air handler 52, process and secondary air enters flow chamber 141 through intake opening 58 and perforated cover 135, as illustrated by arrows 160, and passes through the vertical air plenums 137, 139, as illustrated by arrows 161. The vacuum pressure controlling the individual flows of air into vertical air plenums 137, 139 is selected by orienting spill air control valves 42, 41 to vary the flow resistance to plenums 137, 139, respectively. The air then enters the interior of inner box 138 through slot 146, as illustrated by arrow 162. Finally, the air exits the inner box 138 through exhaust opening 64 as illustrated by arrow 163 and then travels through exhaust conduit 70. The openings 142 in latticed dividers 140 allow the air to move in the cross-machine direction 17 to minimize transverse pressure gradients.

With reference to FIG. 8, the forming chamber 31 constitutes a semi-open structure having a support housing 164 formed of one or more thin, unperforated metal sheets and a perforated metering sheet 166. Metering sheet 166 generally surrounds a process space 171 created between the outlet 34 of the filament drawing device 30 and an inlet 165 to the forming chamber 31. The inlet 165 is located between the outlet of the filament drawing device 30 and the collector 32 so that the filament/air mixture 33 can enter the process space. Top seals 167, 169 are each attached at one end to support housing 164 and have a second end respectively positioned above one of spill air control rollers 38, 40 for forming substantially air-tight, rolling engagements with respective upper portions thereof.

Generally, the metering sheet 166 is any structure operative to regulate the fluid communication between the surrounding ambient environment and the process space 171 inside the forming chamber 31 between the filament drawing device 30 and collector 32. To that end, penetrating through the thickness of the metering sheet 166 is a plurality of holes or pores 168 arranged with a spaced-apart relationship in a random pattern or in a grid, array, matrix or other ordered arrangement. Typically, the pores 168 are symmetrically arranged for providing a symmetrical aspiration of secondary air in the machine direction 15 and in the cross-machine direction 17 from the ambient environment surrounding the forming chamber 31. The pores 168 typically have a circular cross-sectional profile but may be, for example, polygonal, elliptical or slotted. The pores 168 may have a single, uniform cross-sectional area or may have various cross-sectional areas distributed to produce a desired flow of secondary air into the space between the filament drawing device 30 and the forming chamber 31. For a circular cross-sectional profile, the average diameter of the pores 168 is less than about 500 microns and, typically, ranges between about 50 microns to about 250 microns. The pattern of pores 168 may be determined by, for example, a fluid dynamics calculation or may be randomly arranged to provide the desired flow characteristics. The metering sheet 166 may be, for example, a screen or sieve, a drilled, stamped or otherwise produced apertured thin metal plate, or a gas permeable mesh having interconnected gas passageways extending through its thickness.

The metering sheet 166 is characterized by the porosity or the ratio of the total cross-sectional area of the pores 168 to the ratio of the remaining unperforated part of the sheet 166. The pores 168 of the metering sheet 166 provide significant regulation of the flow of secondary air from the surrounding ambient environment induced by aspiration through the sheet 166 and captured by the filament/air mixture 33. The porosity of the metering sheet 166 is characterized by, among other parameters, the number of pores 168, the pattern of the pores 168, the geometrical shape of each pore 168, and the average pore diameter. Typically, the ratio of the total cross-sectional area of the pores 168 to the ratio of the remaining unperforated part of the sheet 166 ranges from about 10% to about 80%.

In one embodiment and as illustrated in FIG. 8, the metering sheet 166 is a thin mesh screen or apertured shear foil that has a limited degree of flexibility. For example, the metering sheet 166 may be a thin foil ranging in thickness from about 10 microns to about 250 microns that is etched chemically to provide pores 168. The flexibility of the metering sheet 166 accommodates the vertical movement of the filament drawing device 30 relative to the collector 32 and, to that end, metering sheet 166 is bent into an arcuate shape The filament/air mixture 33 and the secondary air entrained therein collectively travel toward the collector 32 and the air is exhausted by the air management system 12. The metering sheet 166 significantly reduces the entrainment of secondary air by the flow of filament/air mixture 33 toward collector 32 by restricting the air flow of secondary air from the ambient environment into space between the filament drawing device 30 and the forming chamber 31, which reduces the total volume of air that the air management system 12 must exhaust from zones 35, 36, 37.

With reference to FIGS. 1 and 8 and as described above, the filament drawing device 30 of the spunbonding station 14 attracts filaments 26 exiting the quenching system 28 with suction into inlet 29, attenuates and molecularly orients the filaments 26 with a high velocity flow of process air directed parallel to the direction of motion of the filaments 26, and discharges the attenuated filaments 26 from outlet 34 as a component of filament/air mixture 33. The filament/air mixture 33 consists of attenuated filaments 26 entrained in high velocity process air and transported toward the collector 32, where the filaments 26 are collected to form spunbonded web 20 and the process air is exhausted by the air management system 12. The filament/air mixture 33 captures secondary air from the surrounding environment in flight or transit from the outlet 34 to the collector 32.

Figure 9:
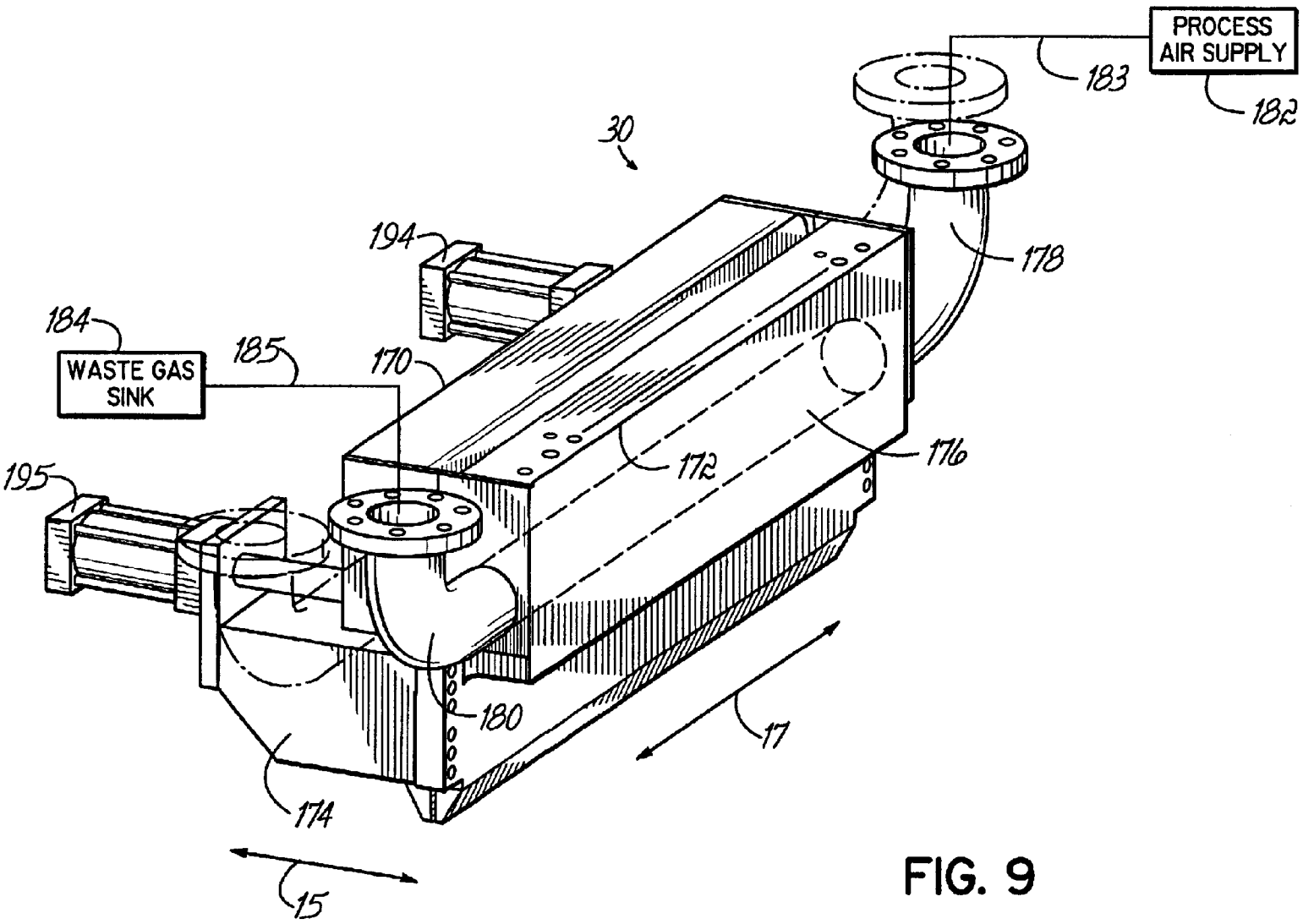
FIG. 9 is a perspective view of the filament drawing device of FIG. 1.
Figure 10:
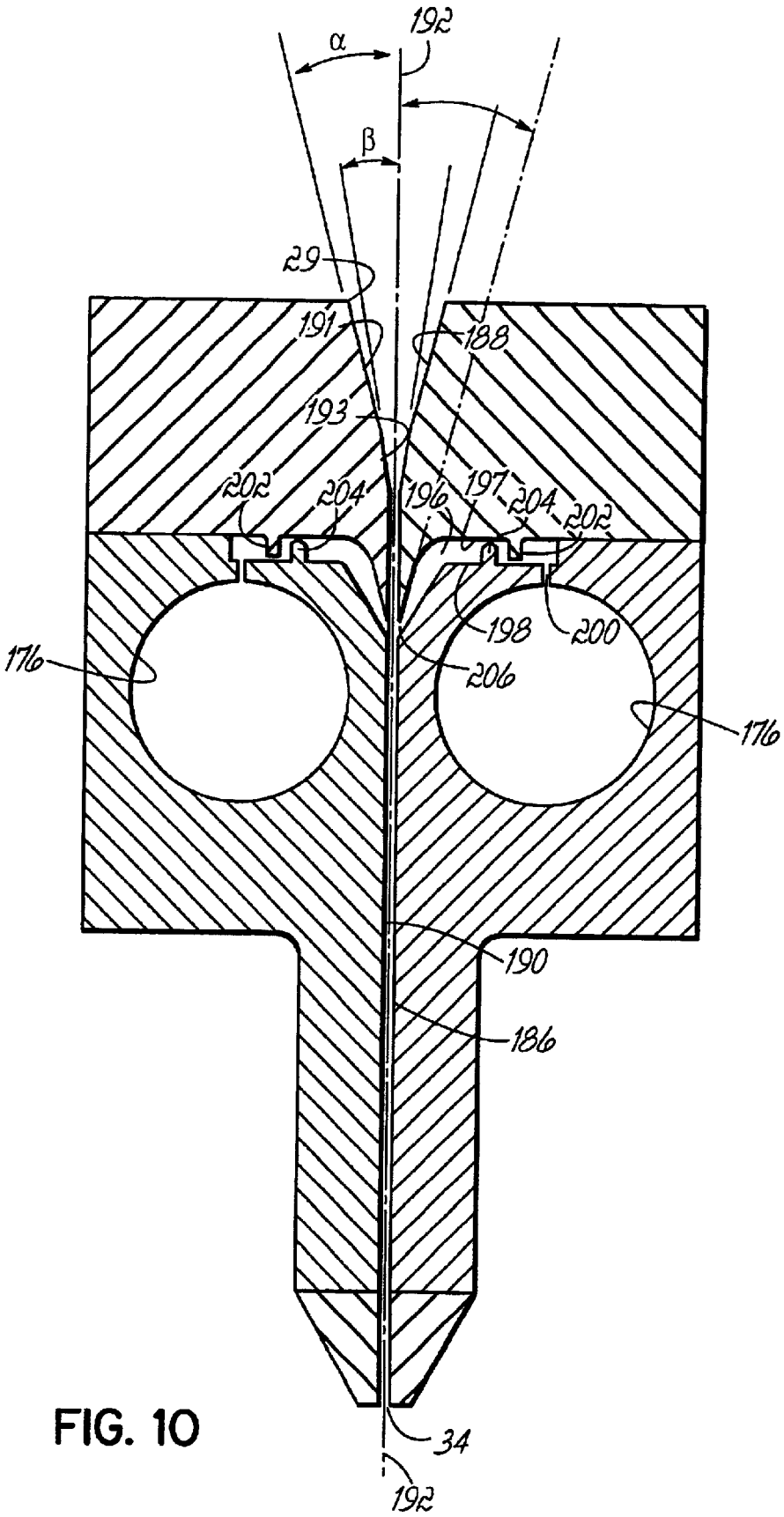
FIG. 10 is a cross sectional view taken generally along line 10-10 of FIG. 9.

With reference to FIGS. 9 and 10, one embodiment of the filament drawing device 30 includes a first process air manifold 170 and a second process air manifold 172 movably attached to the process air manifold 170 by a bracket 174. Each of the process air manifolds 170 and 172 includes a cylindrical flow chamber 176 that extends in the cross-machine direction 17 between a flanged inlet fitting 178 at one end and a flanged exhaust fitting 180 at an opposite end. A flow of temperature-controlled process air is established in each flow chamber 176 between the inlet and exhaust fittings 178, 180. To that end, a pressurized process air supply 182 is coupled in fluid communication with inlet fitting 178 by an air supply conduit 183. A portion of the process air is directed in the filament drawing device 30 so as to attenuate the filaments 26, as will be described below. Residual process air is exhausted from each flow chamber 176 to a waste gas sink 184 via an air exhaust conduit 185 connected to exhaust fitting 180. Typically, the process air supply 182 provides process air at a pressure of about 5 pounds per square inch (psi) to about 100 psi, typically within the range of about 30 psi to about 60 psi, and at a temperature of about 60° F. to about 85° F.

The process air manifolds 170, 172 are separated by a flow passageway or slot 186, best shown in FIG. 10, that extends axially or vertically from inlet 29 to outlet 34 and through which the filaments 26 pass in transit from inlet 29 to outlet 34. The inlet 29 to the filament drawing device 30 has a width in the machine direction 15 that does not limit the suction generated within device 30. The portion of the flow passageway 186 proximate the inlet 29 has a conical or flared throat 188 with a cross-sectional area that tapers to a uniform width channel 190. The flared throat 188 includes a first segment 191 inclined inwardly relative to a vertical axis 192 with a first taper angle $\alpha$ and a second segment 193 inclined inwardly relative to the vertical axis 192 with a second taper angle β, wherein the first taper angle α is greater than the second taper angle β. The flared throat 188 and the channel 190 are in fluid continuity without obstruction or occlusion to the passage of the filaments 26.

The length of the flow passageway 186 in the cross-machine direction 17 is approximately equal to the desired transverse dimension or width of the spunbonded web 20 (FIG. 1) in the cross-machine direction 17. Typical lengths for the flow passageway 186 range from about 1.2 meters to about 5.2 meters for forming spunbonded webs 20 of similar dimensions in the cross-machine direction 17. Typically, the marginal 0.1 meter portions of the spunbonded web 20 are excised and discarded after deposition. The separation between the process air manifolds 170, 172 in the machine direction 15 determines the width of the channel 190 of flow passageway 186.

With continued reference to FIGS. 9–10, process air manifold 170 is movable relative to the process air manifold 172 in the machine direction 15 for varying the width of the channel 190 of flow passageway 186. To that end, process air manifold 170 is movable mounted to the bracket 174 and a pair of electro-pneumatic cylinders 194, 195 are provided that are operative for providing motive power to move process air manifold 170 relative to process air manifold 172. The electro-pneumatic cylinders 194, 195 may vary the width of the channel 190, which alters the properties of the filaments 26 and filament/air mixture 33. In preparation for operation, the width of channel 190 may be varied from about 0.1 mm to about 6 mm and, for most applications, is adjusted so that the separation between the process air manifolds 170, 172 is between about 0.2 mm and about 2 mm. Process air manifold 170 may also be moved a greater distance from process air manifold 172, such as about 10 cm to about 15 cm, to enhance the access to the flow passageway 186 for maintenance events such as removing resin residues and other debris that accumulate during use.

Each of the process air manifolds 170, 172 includes a connecting plenum 196 defined by confronting side walls 197, 198. The connecting plenum 196 couples the flow passageway 186 in fluid communication with each flow chamber 176 so that process air flows from each of the flow chambers 176 into the channel 190 of the flow passageway 186. Specifically, each connecting plenum 196 has is coupled in fluid communication with one of the flow chambers 176 by a plurality of spaced-apart feed holes 200. The feed holes 200 are arranged in a row or other pattern that extends in the cross-machine direction 17 for substantially the entire length of each process air manifold 170, 172. For example, feed holes 200 having a diameter of about 4 mm may be spaced apart such that adjacent pairs of feed holes 200 have a center-to-center spacing of approximately 4.75 mm.

Air flow in each connecting plenum 196 is constricted by a pair of dams or bosses 202, 204 that extend in the cross-machine direction 17. The bosses 202, 204 project inwardly from side walls 197, 198, respectively, of the connecting plenum 196. Bosses 202, 204 are aligned in opposite directions relative to the axis 192 and present a tortuous pathway that significantly reduces the wake turbulence of the process air flowing in each connecting plenum 196. The reduction in the wake turbulence promotes a uniform flow of process air for uniformly and consistently applying the drawing force to the filaments 26, which results in a uniform and predictable attenuation of the filaments 26.

With continued reference to FIGS. 9 and 10, the side walls 197, 198 of the connecting plenum 196 curve and narrow to converge at an elongate discharge slit 206 that provides fluid communication between each connecting plenum 196 and the flow passageway 186. The discharge slit 206 extends in the cross-machine direction 17 for substantially the entire length of each of the process air manifolds 170, 172. Process air is ejected from the discharge slit 206 and enters the channel 190 of flow passageway 186 as an air sheet. Each discharge slit 206 is oriented such that the air sheet is directed downwardly toward the collector 32 and downwardly with respect to the filaments 26 traveling through the channel 190. Specifically, the sheet of process air exiting from the discharge slit 206 is inclined with respect to the axis 192 with an inclination angle between about 5° and about 25° and typically, about 15°.

In use and with reference to FIGS. 9 and 10, process gas flowing in each flow chamber 176 enters the respective connecting plenum 196 through the feed holes 200 and is accelerated to a high speed in the connecting plenum 196 before entering the channel 190 through the discharge slit 206 as a homogeneous air sheet of substantially uniform velocity directed substantially axially toward the outlet 34. As the filaments 26 pass through flow passageway 186, the converging air sheets ejected from the discharge slit 206 of each of the process air manifolds 170, 172 imparts drag forces to the filaments 26 and attenuates, stretches or otherwise draws down the filaments 26 to a reduced diameter. The air sheets entering the channel 190 of flow passageway 186 create a suction at the inlet 29 that supplies the tensile force operative for attenuating the fibers 26 and that aspirates secondary air from the ambient environment into the inlet 29. The filament drawing force increases as the air velocity of each air sheet increases. The reduction of the filament diameter is also a function of distance from filament drawing device 30 to the extrusion die 25.

The process air manifolds 170, 172 are preferably formed of any material that is dimensionally and thermally stable under the operating conditions of the filament drawing device 30 so that dimensional tolerances are unchanging during operation. Stainless steels suitable for forming the process air manifolds 170, 172 include a Carpenter Custom type 450 stainless steel alloy and a type 630 precipitation-hardened 17Cr-4Ni stainless steel alloy each available commercially from Carpenter Technology Corp. (Reading, Pa.).

The filament drawing device 30 of the present invention operates at a lesser pressure than conventional filament drawing devices while providing a comparable or improved fiber attenuation. Although the pressure of the process air is reduced, the filament drawing device 30 is highly efficient and the velocity of the filaments 26 in the filament/air mixture 33 is adequate to ensure high-quality fiber laydown for forming spunbonded web 20. In particular, the filament drawing device 30 provides spinning speeds, as represented by the linear velocities for filaments 26, that range from 8,000 m/min up to about 12,000 m/min. The reduction in the pressure of high-velocity process air exiting the outlet 34 also reduces the entrained volume of secondary air from the ambient environment between the outlet 34 of the filament drawing device 30 and the collector 32. According to principles of the present invention, filament drawing device 30 enhances the spinning speed while simultaneously reducing the volume of secondary and process air that the air management system 12 must manage and, in doing so, enhances the characteristics of the spunbonded web 20 formed on collector 32.

Figure 11:
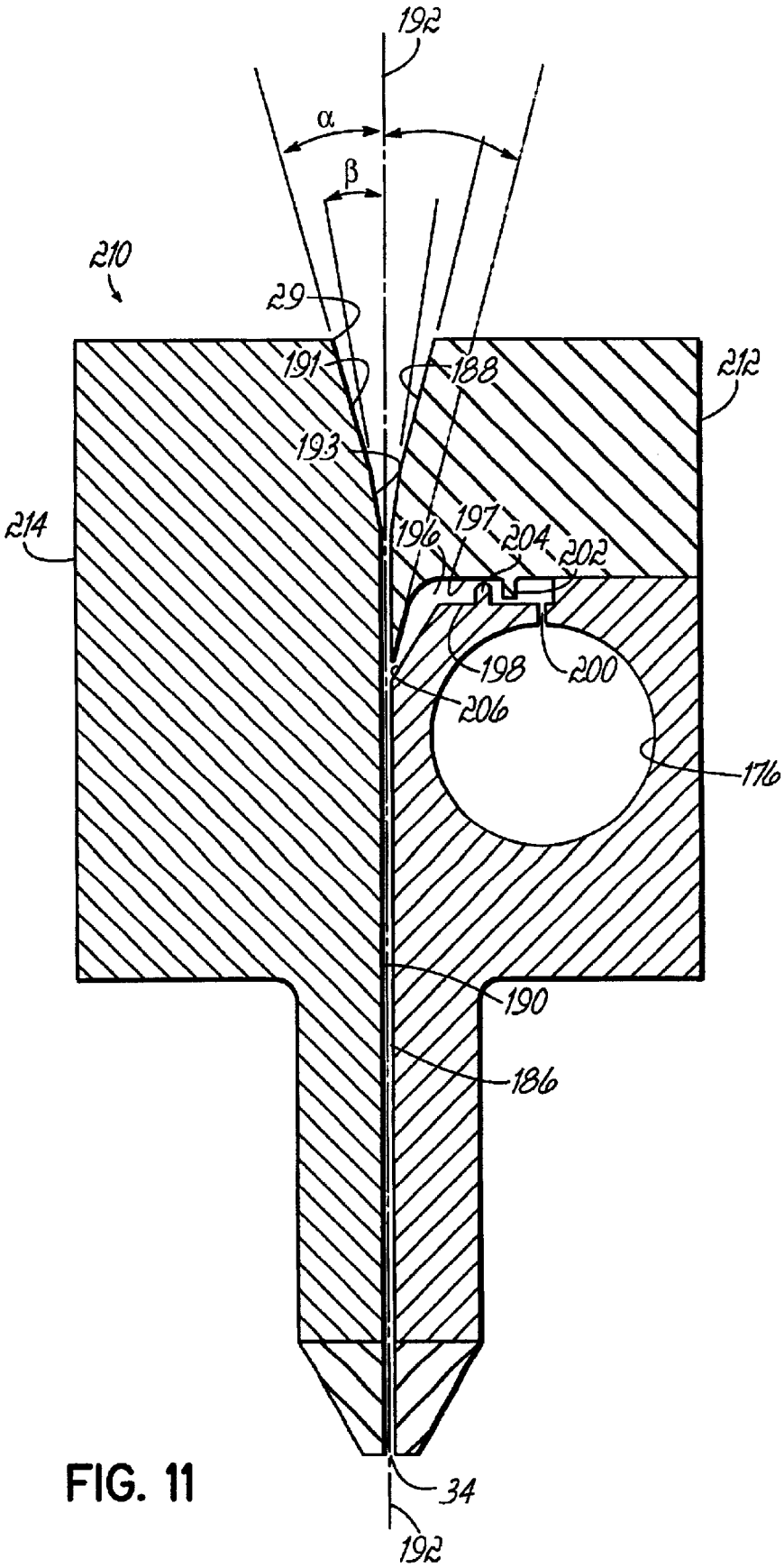
FIG. 11 is a cross-sectional view of an alternative embodiment of the filament drawing device of FIG. 9.

With reference to FIG. 11 in which like reference numerals refer to like features in FIGS. 9 and 10, an alternative embodiment of the filament drawing device 210 includes a single process air manifold 212 similar to the process air manifolds 170, 172 of filament drawing device 30, and a flow diverter 214 that replaces process air manifold 170. The flow diverter 214 includes a solid interior that lacks flow passageways for process air. In certain embodiments, the flow diverter 214 may be formed by blanking or otherwise disabling the inlet 178 and the outlet 180 of one of process air manifold 170 (FIGS. 9 and 10) so that the flow chamber 176 is inoperable.

The air management system 12 permits a significant degree of control over the properties of the spunbonded web 20 formed by spunbonding station 14. Generally, the properties of spunbonded web 20 are a complex function of parameters including the temperature of the filaments 26, the temperature of the process air in the quenching system 28, the temperature of the process air in the filament drawing device 30, and the velocity and volume of the process air at the collector 32. Typically, the spunbonded web 20 has a filament size greater than about 1 denier and a web weight ranging from about 4 $g/m^2$ to about 500 $g/m^2$.

Adjustment of the relative positions of the spill air control valves 41–44 of air management system 12, in conjunction with the guide paths for the high velocity process and secondary air provided by the spill air control rollers 38, 40, permits the air flow velocity in the machine direction 15 to be selectively controlled or regulated. The ability to regulate the air flow velocity in the machine direction 15 allows the ratio of the average fiber orientation in the machine direction 15 to the average fiber orientation in the cross-machine direction 17, referred to hereinafter as the MD/CD laydown ratio, to be tailored. Specifically, adjustment of the positions of the spill air control valves 41–44 alters the flow resistance in the vertical air plenums 137, 139 and, thereby, permits the MD/CD laydown ratio to be adjusted from a value of 1:1, connoting isotropic or symmetrical fiber laydown of spunbonded web 20, to values as large as 5:1, which connotes a highly asymmetrical or anisotropic fiber laydown to form spunbonded web 20.

The resin used to fabricate the spunbonded web 20 formed by spunbonding station 14 can be any of the commercially available spunbond grades of a wide range of thermoplastic polymeric materials including without limitation polyolefins, polyamides, polyesters, polyamides, polyvinyl acetate, polyvinyl chloride, polyvinyl alcohol, cellulose acetate, and the like. Polypropylene, because of its availability and low relative cost, is a common thermoplastic resin used to form spunbonded web 20. The filaments 26 used in making spunbonded web 20 may have any suitable morphology and may include hollow or solid, straight or crimped, single component, bi-component or multi-component fibers or filaments, and blends or mixes of such fibers and/or filaments, as are well known in the art. To produce bi-component and multi-component filaments and/or fibers, for example, the melt spinning assembly 24 and the extrusion die 25 are adapted to extrude multiple types of thermoplastic resins. An exemplary melt spinning assembly 24 and extrusion die 25 having a spin pack capable of extruding multi-component filaments to form multi-component spunbonded webs 20 is described in commonly-assigned, U.S. patent application Ser. No. 09/702,385, now U.S. Pat. No. 6,478,563, entitled "Apparatus for Extruding Multi-Component Liquid Filaments" and filed Oct. 31, 2000.

In certain embodiments of the present invention, it is understood that the filament drawing device 30 of spunbonding station 14 may have a conventional construction and that the properties of spunbonded web 20 fabricated by spunbonding station 14 incorporating a conventional filament drawing device will benefit from the presence of air management system 12. Specifically, the MD/CD laydown ratio may be controlled, as described above, independently of the construction of the filament drawing device 30. The filament drawing device 30 of the present invention, shown in FIGS. 9–11, enhances the filament linear velocity so that the filaments 26 are attenuated to a greater extent possible with the attenuation achievable with conventional filament drawing devices. In particular, conjunctive use of the air management system 12 and filament drawing device 30 of the present invention provides the optimal degree of control over the properties of spunbonded web 20.

While the present invention has been illustrated by a description of various preferred embodiments and while these embodiments have been described in considerable detail in order to describe the best mode of practicing the invention, it is not the intention of the applicant to restrict or in any way limit the scope of the appended claims to such detail. Additional advantages and modifications within the spirit and scope of the invention will readily appear to those skilled in the art.

The invention itself should only be defined by the appended claims, wherein I claim:

1. An air handler for positioning below a melt spinning apparatus configured to discharge filaments of material onto a collector moving in a machine direction and collecting air discharged from the melt spinning apparatus, said air handler comprising:

an outer housing having first walls defining a first interior space, one of said first walls having an intake opening positioned below the collector for admitting the discharged air into said first interior space and another of said first walls having an exhaust opening for exhausting the discharged air;

an inner housing positioned within said first interior space and having second walls defining a second interior space coupled in fluid communication with said exhaust opening in said outer housing, one of said second walls of said inner housing having an elongate slot with a major dimension extending in a cross-machine direction, said elongate slot coupling said first interior space in fluid communication with said second interior space; and a first adjustable flow control device positioned in said first interior space, said first flow control device operative for controlling the flow of the discharged air between said first interior space and said second interior space.

2. The air handler of claim 1, wherein said first interior space includes a flow chamber and a first plenum extending between an air inlet port coupled in fluid communication with said flow chamber and said elongated slot, said flow chamber positioned between said intake opening and said inner housing, and said first adjustable flow control device positioned proximate to said air inlet port of said first plenum for controlling the flow of discharged air from said flow chamber through said air inlet port of said first plenum into said first plenum.

3. The air handler of claim 2, wherein said first interior space includes a second plenum extending between said flow chamber and said elongated slot, said second plenum fluidically isolated from said first plenum.

4. The air handler of claim 3, further comprising a second adjustable flow control device positioned in said first interior space, said second flow control device operative for controlling the flow of discharged air between said first interior space and said second interior space.

5. The air handler of claim 3, said second adjustable flow control device is positioned proximate to said air inlet port of said second plenum for controlling the flow of discharged air from said flow chamber through said air inlet port of said second plenum into said second plenum.

6. The air handler of claim 1, further comprising an air-directing member positioned outside of said first interior space proximate to said intake opening, said air-directing member extending in a cross-machine direction and dividing said intake opening into first and second portions in the machine direction.

7. The air handler of claim 6, wherein said air-directing member is a first roller having a rolling contact with said collector.

8. The air handler of claim 7, further comprising a second roller positioned generally inside of said first interior space and proximate to said intake opening, said second roller positioned relative to said first roller such that at least the collector is captured with a rolling engagement between said first and said second rollers.

9. An air handler for positioning below a melt spinning apparatus configured to discharge filaments of material onto a collector moving in a machine direction and collecting air discharged from the melt spinning apparatus, said air handler comprising:

an outer housing having first walls defining a first interior space, one of said first walls having an intake opening positioned below the collector for admitting the discharged air into said first interior space and another of said first walls having an exhaust opening for exhausting the discharged air;

an inner housing positioned within said first interior space and having second walls defining a second interior space coupled in fluid communication with said exhaust opening in said outer housing, one of said second wails of said inner housing having an elongate slot with a major dimension extending in cross-machine direction, said elongate slot coupling said first interior space in fluid communication with said second interior space; and an air-directing member positioned outside of said first interior space proximate to said intake opening, said air-directing member extending in a cross-machine direction and dividing said intake opening into first and second portions in the machine direction.

10. The air handler of claim 9, wherein said air-directing member is a first roller having a rolling contact with said collector.

11. The air handler of claim 10, further comprising a second roller positioned generally inside of said first interior space and proximate to said intake opening, said second roller positioned relative to said first roller such that the collector is captured with a rolling engagement between said first and said second rollers.

12. The air handler of claim 10, further comprising a forming chamber at least partially surrounding said intake opening and said first roller, said forming chamber providing a process space between the melt spinning assembly and the collector for the passage of filaments of material to the collector, and said first portion of said intake opening positioned inside said forming chamber and said second portion of said intake opening positioned outside of said forming chamber.

13. The air handler of claim 11, wherein said forming chamber further comprises a perforated metering sheet for regulating the flow of air from the ambient environment surrounding said forming chamber into said process space.

14. The air handler of claim 9, further comprising a flow control device positioned in said first interior space, said flow control device operative for controlling the flow of discharged air between said first interior space and said second interior space.

15. A system for depositing a spunbond layer on a collector moving in a machine direction, comprising:

a melt spinning apparatus operative to extrude filaments of material, said melt spinning apparatus positioned vertically above the collector; and an air management operative to collect air discharged from said melt spinning apparatus, said air handler comprising:

a first air handler positioned directly below said melt spinning apparatus in a forming zone, a second air handler being positioned upstream of said first air handler and the forming zone, and a third air handler being positioned downstream of said first air handler and the forming zone, each of said air handlers including:

an outer housing having first walls defining a first interior space, one of said first walls having an intake opening positioned below the collector for admitting the discharged air into said first interior space and another of said first walls having an exhaust opening for exhausting the discharged air; and an inner housing positioned within said first interior space and having second walls defining a second interior space coupled in fluid communication with said exhaust opening in said outer housing, one of said second walls of said inner housing having an elongate slot with a major dimension extending in cross-machine direction, said elongate slot coupling said first interior space in fluid communication with said second interior space; and said second and third air handlers each including:

an air-directing member positioned outside of said first interior space proximate to said intake opening, said air-directing member extending in a cross-machine direction and dividing said intake opening into first and second portions in the machine direction; and an adjustable flow control device positioned in said first interior space, said first flow control device operative for controlling the flow of the discharged air between said first interior space and said second interior space.

16. The system of claim 15, further comprising a filament drawing device positioned vertically between said melt spinning apparatus and the collector, said filament drawing device operative for providing an air flow sufficient to attenuate the filaments of material.

17. The system of claim 16, further comprising a quench system positioned between said melt spinning apparatus and said filament drawing device, said quench system operative for providing a flow of quenching air to cool the filaments of material extruded from said melt spinning apparatus.

18. The system of claim 15, further comprising a forming chamber at least partially surrounding said intake openings and said air-directing members, said enclosure defining a process space positioned between said melt spinning apparatus and the collector for the passage of filaments of material to the collector.

19. The system of claim 18, wherein said forming chamber further comprises a perforated metering sheet for regulating the flow of air from the ambient environment surrounding said forming chamber into said process space.

20. A apparatus configured to discharge filaments of material onto a collector moving in a machine direction, comprising:

a melt spinning apparatus operative for extruding filaments of material;

a filament drawing device positioned between said melt spinning apparatus and the collector, said filament drawing device having an inlet for receiving the filaments of material from said melt spinning apparatus and an outlet for discharging said filaments of material toward the collector, said filament drawing device operative for providing a flow of process air sufficient to attenuate the filaments of material and the flow of process air entraining secondary air from the ambient environment between said outlet and the collector;

an air handler having an intake opening positioned proximate to the collector, said air handler collecting process air discharged from said filament drawing device and entrained secondary air through said intake opening; and a forming chamber having a side wall at least partially surrounding said intake opening of said air handler and said outlet of said filament drawing device, an entrance opening upstream of the intake opening, and an exit opening downstream of the intake opening, said side wall defining a process space for the passage of the filaments of material from said outlet of said filament drawing device to the collector and partitioning said process space from the surrounding ambient environment and said entrance and exit openings dimensioned so that at least the collector can traverse said process space, and said side wall of said forming chamber including a perforated metering sheet configured to regulate the flow of air from the ambient environment into said process space.

21. The system of claim 20, further comprising a quench system positioned between said melt spinning apparatus and said filament drawing device, said quench system operative for providing a flow of quenching air to cool the filaments of material extruded from said melt spinning apparatus.

22. The air handler of claim 20, further comprising a first air-directing member positioned upstream of said intake opening, said first air-directing member extending in a cross-machine direction and spaced from said intake opening so as to provide said entrance opening.

23. The air handler of claim 22, further comprising a second air-directing member positioned downstream of said intake opening, said second air-directing member extending in a cross-machine direction and spaced from said intake opening so as to provide said exit opening.

* * * * *